US010217394B2

(12) United States Patent
Yu et al.

(10) Patent No.: US 10,217,394 B2
(45) Date of Patent: Feb. 26, 2019

(54) DISPLAY DRIVING APPARATUS AND DISPLAY DRIVING METHOD

(71) Applicant: Novatek Microelectronics Corp., Hsinchu (TW)

(72) Inventors: Wenhui Yu, ShanXi Province (CN); Chao-Yang Kao, Hsinchu (TW); Chiung-Liang Lin, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 244 days.

(21) Appl. No.: 15/281,104

(22) Filed: Sep. 30, 2016

(65) Prior Publication Data

US 2018/0082628 A1 Mar. 22, 2018

(30) Foreign Application Priority Data

Sep. 20, 2016 (CN) ..... 2016 1 0833010

(51) Int. Cl.
*G09G 3/20* (2006.01)

(52) U.S. Cl.
CPC ..... *G09G 3/2092* (2013.01); *G09G 2310/027* (2013.01); *G09G 2340/02* (2013.01); *G09G 2340/16* (2013.01)

(58) Field of Classification Search
CPC combination set(s) only.
See application file for complete search history.

(56) References Cited

U.S. PATENT DOCUMENTS 9,171,491 B1 * 10/2015 Kwon ..... G09G 3/3648
2016/0300521 A1 * 10/2016 Wang ..... G09G 3/2003
2017/0309214 A1 * 10/2017 Park ..... G09G 3/2003

* cited by examiner

*Primary Examiner* — Jennifer Mehmood
*Assistant Examiner* — Deeprose Subedi
(74) *Attorney, Agent, or Firm* — JCIPRNET

(57) ABSTRACT

A display driving apparatus including a pixel reorder circuit, an image processing circuit and a driver circuit is provided. The pixel reorder circuit is configured to reorder pixels of frame data. The frame data includes previous frame data. The image processing circuit is coupled to the pixel reorder circuit. The image processing circuit is configured to perform an image processing operation on the frame data that the pixels have been reordered. The driver circuit is coupled to the pixel reorder circuit. The driver circuit is configured to drive a display according to the previous frame data that pixels have been reordered and the current frame data. Each of the pixels of the frame data includes a first sub-pixel set and a second sub-pixel set. In addition, a display driving method is also provided.

20 Claims, 10 Drawing Sheets

DISPLAY DRIVING APPARATUS AND DISPLAY DRIVING METHOD

CROSS-REFERENCE TO RELATED APPLICATION

This application claims the priority benefit of China application serial no. 201610833010.2, filed on Sep. 20, 2016. The entirety of the above-mentioned patent application is hereby incorporated by reference herein and made a part of this specification.

BACKGROUND OF THE INVENTION

1. Field of the Invention

The invention generally relates to a driving apparatus and a driving method, in particular, to a display driving apparatus and a display driving method.

2. Description of Related Art

Along with quick development of display technology, current market requirements for display panel performance have a trend of high resolution, high brightness and low power consumption, etc. However, along with increase of the resolution of the display panel, in order to display a high resolution, the number of sub-pixels on the display panel is also increased, so that manufacturing cost of the display panel is increased. In order to decrease the manufacturing cost of the display panel, a sub-pixel rending method (SPR method) is developed. A display apparatus applies different sub-pixel arrangements and designs to implement an appropriate algorithm, so that the resolution of the display panel displaying an image can be enhanced to a sub-pixel resolution. Since a size of the sub-pixel is smaller than that of a pixel, the resolution of the image perceived by human eyes (i.e. a visual resolution) is enhanced. However, some image process operations, e.g. compression/decompression, are simply designed for a conventional display panel, such that image process quality may be poor, and image process efficiency is low in related art.

Therefore, how to design a display driving apparatus capable of improving image process quality and enhancing image process efficiency is an important issue for those technicians of the field.

SUMMARY OF THE INVENTION

Accordingly, the invention is directed to a display driving apparatus and a display driving method capable of improving image process quality and enhancing image process efficiency.

An exemplary embodiment of the invention provides a display driving apparatus. The display driving apparatus includes a pixel reorder circuit, an image processing circuit and a driver circuit. The pixel reorder circuit is configured to reorder pixels of frame data. The frame data includes previous frame data. The image processing circuit is coupled to the pixel reorder circuit. The image processing circuit is configured to perform an image processing operation on the frame data that the pixels have been reordered. The driver circuit is coupled to the pixel reorder circuit. The driver circuit is configured to drive a display according to the previous frame data that pixels have been reordered and the current frame data. Each of the pixels of the frame data includes a first sub-pixel set and a second sub-pixel set.

In an exemplary embodiment of the invention, the image processing circuit separately performs the image processing operation on the first sub-pixel set and the second sub-pixel set according to the same parameter or different parameters.

In an exemplary embodiment of the invention, the image processing circuit performs the image processing operation on one of the first sub-pixel set and the second sub-pixel set according to the other of the first sub-pixel set and the second sub-pixel set.

In an exemplary embodiment of the invention, the image processing circuit analyses a variance of the first sub-pixel set. If the variance is smaller than the threshold, the image processing circuit performs the image processing operation on the first sub-pixel set and the second sub-pixel set according to the same parameter.

In an exemplary embodiment of the invention, if the variance is not smaller than the threshold, the image processing circuit performs the image processing operation on the first sub-pixel set and the second sub-pixel set according to different parameters.

In an exemplary embodiment of the invention, the pixels of the frame data include a plurality of sub-pixels. Relative positions of the sub-pixels after reorder are different from relative positions of the sub-pixels before reorder.

In an exemplary embodiment of the invention, the pixels of the frame data include a plurality of sub-pixels. Relative positions of the sub-pixels after reorder are the same as relative positions of the sub-pixels before reorder.

In an exemplary embodiment of the invention, the first sub-pixel set includes a red sub-pixel, a first green sub-pixel, and a blue sub-pixel. The second sub-pixel set includes a sub-pixel selected from one of a white sub-pixel, a yellow sub-pixel, a second green sub-pixel, and a cyan sub-pixel.

In an exemplary embodiment of the invention, when the image processing circuit performs the image processing operation on the frame data that the pixels have been reordered, the image processing circuit processes the frame data that the pixels have been reordered and inversely processes the processed frame data.

In an exemplary embodiment of the invention, the image processing circuit includes a compression circuit, a memory circuit, and a decompression circuit. The compression circuit is coupled to the pixel reorder circuit. The compression circuit is configured to compress the frame data that the pixels have been reordered. The memory circuit is coupled to the compression circuit. The memory circuit is configured to store the compressed frame data. The decompression circuit is coupled to the memory circuit. The decompression circuit is configured to decompress the compressed frame data from the memory circuit and transmit the decompressed frame data to the pixel reorder circuit.

In an exemplary embodiment of the invention, the compression circuit includes two data processing channels configured to respectively process the frame data of the first sub-pixel set and the second sub-pixel set.

An exemplary embodiment of the invention provides a display driving method adapted to a display driving apparatus. The display driving method includes: reordering pixels of frame data, where the frame data comprises previous frame data; performing an image processing operation on the frame data that the pixels have been reordered; and driving a display according to the previous frame data that pixels have been reordered and the current frame data. Each of the pixels of the frame data includes a first sub-pixel set and a second sub-pixel set.

In an exemplary embodiment of the invention, in the step of performing the image processing operation on the frame data that the pixels have been reordered, the image processing operation is separately performed on the first sub-pixel set and the second sub-pixel set according to the same parameter or different parameters.

In an exemplary embodiment of the invention, in the step of performing the image processing operation on the frame data that the pixels have been reordered, the image processing operation is performed on one of the first sub-pixel set and the second sub-pixel set according to the other of the first sub-pixel set and the second sub-pixel set.

In an exemplary embodiment of the invention, the display driving method further includes: analysing a variance of the first sub-pixel set. If the variance is smaller than a threshold, in the step of performing the image processing operation on the frame data that the pixels have been reordered, the image processing operation is performed on the first sub-pixel set and the second sub-pixel set according to the same parameter.

In an exemplary embodiment of the invention, if the variance is not smaller than the threshold, in the step of performing the image processing operation on the frame data that the pixels have been reordered, the image processing operation is performed on the first sub-pixel set and the second sub-pixel set according to different parameters.

In an exemplary embodiment of the invention, the pixels of the frame data include a plurality of sub-pixels. Relative positions of the sub-pixels after reorder are different from relative positions of the sub-pixels before reorder.

In an exemplary embodiment of the invention, the pixels of the frame data include a plurality of sub-pixels. Relative positions of the sub-pixels after reorder are the same as relative positions of the sub-pixels before reorder.

In an exemplary embodiment of the invention, the first sub-pixel set includes a red sub-pixel, a first green sub-pixel, and a blue sub-pixel. The second sub-pixel set includes a sub-pixel selected from one of a white sub-pixel, a yellow sub-pixel, a second green sub-pixel, and a cyan sub-pixel.

In an exemplary embodiment of the invention, in the step of performing the image processing operation on the frame data that the pixels have been reordered, the frame data that the pixels have been reordered is processed, and the processed frame data is inversely processed.

In an exemplary embodiment of the invention, the step of performing the image processing operation on the frame data that the pixels have been reordered includes: compressing the frame data that the pixels have been reordered; storing the compressed frame data; and decompressing the compressed frame data from the memory circuit.

In an exemplary embodiment of the invention, in the step of reordering the pixels of the frame data, the reordered pixels of the frame data are further inversely reordered.

According to the above descriptions, in the exemplary embodiments of the invention, the driver circuit drives the display according to the previous frame data and the current frame data, where the pixels of the previous frame data are reordered. Accordingly, the display driving apparatus can improve image process quality and enhance image process efficiency.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
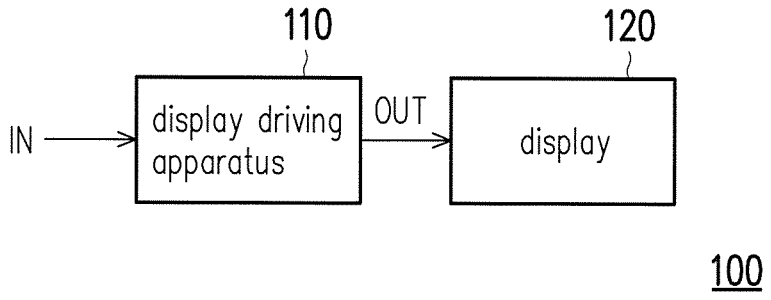
FIG. 1 illustrates a schematic diagram of a display driving system according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

The term "coupling/coupled" used in this specification (including claims) of the disclosure may refer to any direct or indirect connection means. For example, "a first device is coupled to a second device" should be interpreted as "the first device is directly connected to the second device" or "the first device is indirectly connected to the second device through other devices or connection means." In addition, the term "signal" can refer to a current, a voltage, a charge, a temperature, data, electromagnetic wave or any one or multiple signals.

FIG. 1 illustrates a schematic diagram of a display driving system according to an embodiment of the invention. Referring to FIG. 1, the display apparatus 100 of the present embodiment includes a display driving apparatus 110 and a display 120. In the present embodiment, the display driving apparatus 110 receives a frame data IN, where the frame data IN includes a previous frame data and a current frame data. The display driving apparatus 110 reorders pixels of the frame data IN, and performs an image processing operation on the frame data IN that the pixels have been reordered. The display driving apparatus 110 generates a driving signal OUT to drive the display 120 according to the pixels of the reordered frame data IN that the image processing operation has been applied. In the present embodiment, the display driving apparatus 110 drives the display 120 according to the previous frame data that pixels have been reordered and the current frame data. The display driving apparatus 110 may drive the display 120 to display an image frame by using a sub-pixel rendering (SPR) method.

Figure 2:
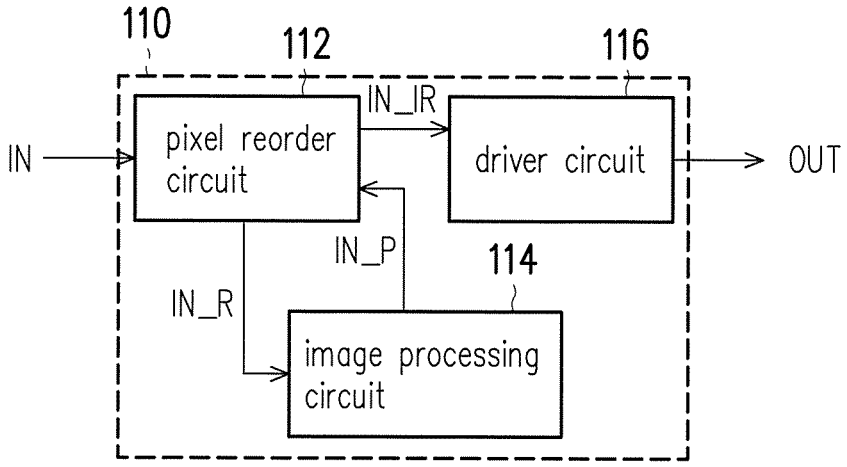
FIG. 2 illustrates a schematic diagram of the display driving apparatus depicted in FIG. 1.
Figure 3A:
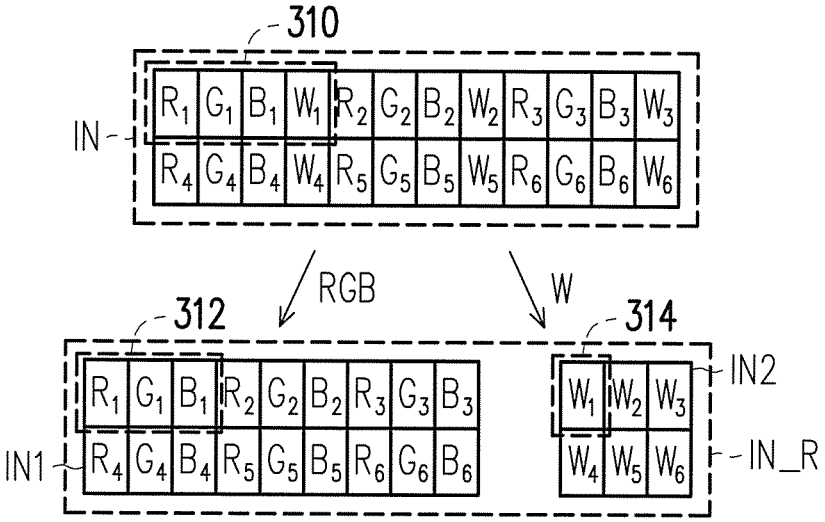
FIG. 3A, FIG. 4A, FIG. 5A and FIG. 6A respectively illustrate schematic diagrams of sub-pixel arrangements of the frame data IN and the frame data IN_R according to different embodiments of the invention.
Figure 3B:
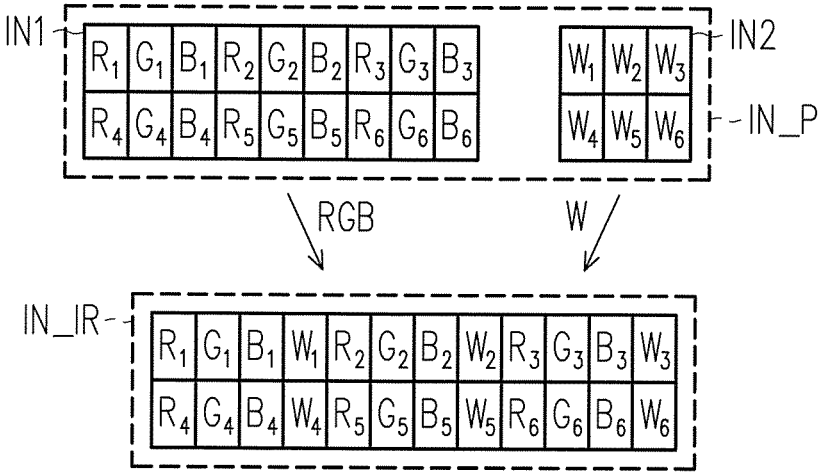
FIG. 3B, FIG. 4B, FIG. 5B and FIG. 6B respectively illustrate schematic diagrams of sub-pixel arrangements of the frame data IN_P and the frame data IN_IR according to different embodiments of the invention.

To be specific, FIG. 2 illustrates a schematic diagram of the display driving apparatus depicted in FIG. 1. FIG. 3A illustrates a schematic diagram of sub-pixel arrangements of the frame data IN and the frame data IN_R according to an embodiment of the invention. FIG. 3B illustrates a schematic diagram of sub-pixel arrangements of the frame data IN_P and the frame data IN_IR according to an embodiment of the invention. Referring to FIG. 1 to FIG. 3B, the display driving apparatus 110 of the present embodiment includes a pixel reorder circuit 112, an image processing circuit 114, and a driver circuit 116. The pixel reorder circuit 112 receives the frame data IN, and reorders the pixels of the frame data IN to generate a frame data IN_R as illustrated in FIG. 3A, where the frame data IN_R is the frame data IN that the pixels have been reordered. The pixel reorder circuit 112 transmits the frame data IN_R to the image processing circuit 114. The image processing circuit 114 performs the image processing operation on the frame data IN_R, and thus generates a frame data IN_P, where the frame data IN_P is the frame data IN_R that the image processing operation has been applied. In the present embodiment, the image processing operation may be applied to the frame data to adjust image content characteristics, such as image resolution, the image brightness, image spectral distribution, image resolution, image discrepancy, image relevancy, image color depth, image refresh rate, display mode or other similar characteristics. In an embodiment, the image processing operation may be applied to the frame data to compress and/or decompress the frame data.

In the present embodiment, the pixel reorder circuit 112 may further reorder the pixels of the frame data IN_P to generate a frame data IN_IR as illustrated in FIG. 3B, and transmit the frame data IN_IR to the driver circuit 116, where the frame data IN_IR is the frame data IN_P that the pixels have been reordered. The driver circuit 116 outputs the driving signal OUT to drives the display 120 according to the previous frame data that pixels have been reordered and the current frame data. In an embodiment, the driver circuit 116 may obtain an appropriate overdrive value according to a lookup table (LUT), so as to drives the display 120 to display the image frame.

In the present embodiment, the display 120 may include flat panel displays, curved panel displays or 3D displays, including Liquid Crystal Display (LCD), Plasma Display Panel (PDP), Organic Light Emitting Display (OLED), Field Emission Display (FED), Electro-Phoretic Display (EPD) or Light Emitting Diode Display and the like, which are not limited by the invention.

In the present embodiment, the pixel reorder circuit 112, the image processing circuit 114, and the driver circuit 116 may be implemented by using any adaptive circuit in the related art, which are not particularly limited by the invention. Enough teaching, suggestion, and implementation illustration for aforesaid circuits and embodiments thereof may be obtained with reference to common knowledge in the related art, which is not repeated hereinafter.

In FIG. 3A, the frame data IN_R is the frame data IN that the pixels have been reordered. In the present embodiment, each of the pixels of the frame data IN includes a first sub-pixel set and a second sub-pixel set. For example, the pixel 310 of the frame data IN includes a first sub-pixel set 312 and a second sub-pixel set 314. The first sub-pixel set 312 includes a red sub-pixels $R_1$, a green sub-pixel $G_1$ (the first green sub-pixel), and a blue sub-pixel $B_1$. The second sub-pixel set 314 includes a white sub-pixel $W_1$, but the invention is not limited thereto. In an embodiment, the second sub-pixel set 314 may include a yellow sub-pixel, a green sub-pixel (the second green sub-pixel), or a cyan sub-pixel. Sub-pixel sets included in other pixels of the frame data IN may be deduced by analogy, and it is not further described herein.

In the present embodiment, relative positions of the sub-pixels after reorder are the same as relative positions of the sub-pixels before reorder. For example, relative positions of the sub-pixels $R_1$ to $R_6$, $G_1$ to $G_6$ and $B_1$ to $B_6$ located in the reordered frame data IN1 are the same as the relative positions of the sub-pixels $R_1$ to $R_6$, $G_1$ to $G_6$ and $B_1$ to $B_6$ located in the frame data IN, but the invention is not limited thereto. In an embodiment, relative positions of the sub-pixels after reorder may be different from relative positions of the sub-pixels before reorder.

In FIG. 3B, the frame data IN_P is the frame data IN_R that the image processing operation has been applied, and the frame data IN_IR is the frame data IN_P that the pixels have been reordered. Compared to the frame data IN and IN_R depicted in FIG. 3A, the frame data IN_P depicted in FIG. 3B are inversely reordered to generate the frame data IN_IR, and the image processing operation has been applied to the frame data IN_IR.

Figure 4A:
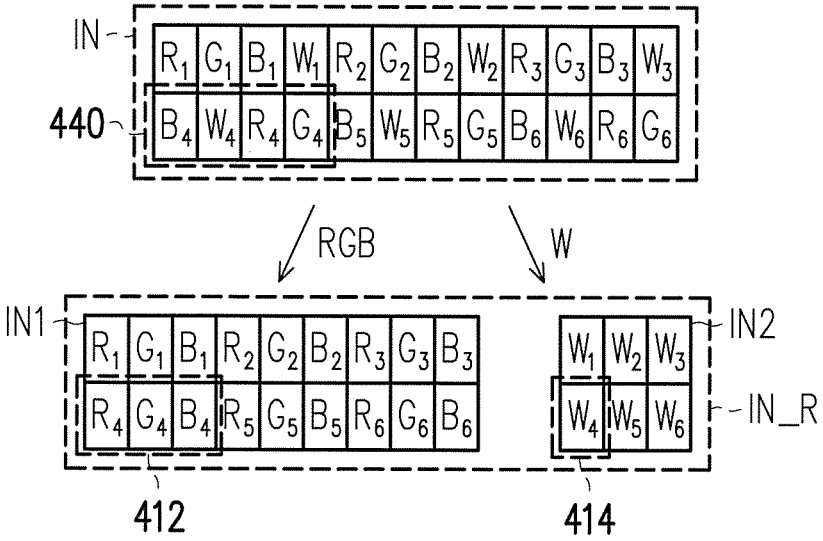
Figure 4B:
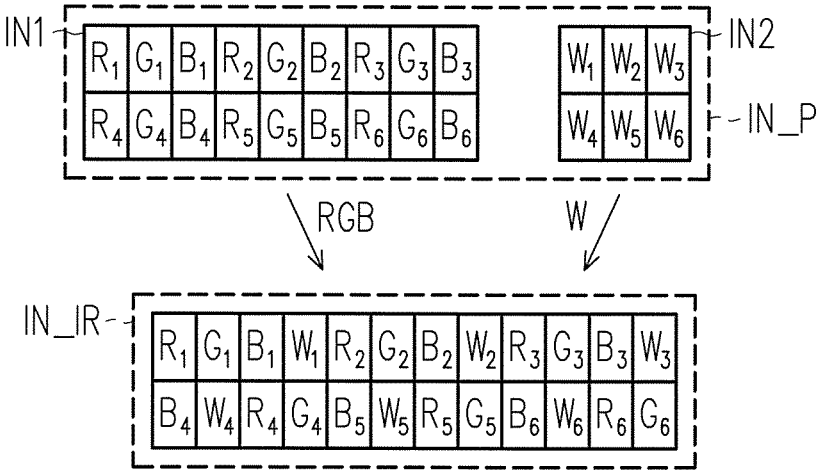

FIG. 4A illustrates a schematic diagram of sub-pixel arrangements of the frame data IN and the frame data IN_R according to another embodiment of the invention. FIG. 4B illustrates a schematic diagram of sub-pixel arrangements of the frame data IN_P and the frame data IN_IR according to another embodiment of the invention. Referring to FIG. 3A to FIG. 4B, the sub-pixel arrangements of the present embodiment are similar to the sub-pixel arrangements depicted in FIG. 3A and FIG. 3B, and the main difference therebetween, for example, lies in that relative positions of the sub-pixels after reorder are different from relative positions of the sub-pixels before reorder.

To be specific, in FIG. 4A, taking the pixel 440 for example, relative positions of the sub-pixels $R_4$, $G_4$ and $B_4$ after reorder are different from relative positions of the sub-pixels $B_4$, $R_4$ and $G_4$ before reorder. The sub-pixel arrangements of other pixels located in the second row of the frame data IN and the frame data IN1 may be deduced by analogy, and it is not further described herein.

Figure 5A:
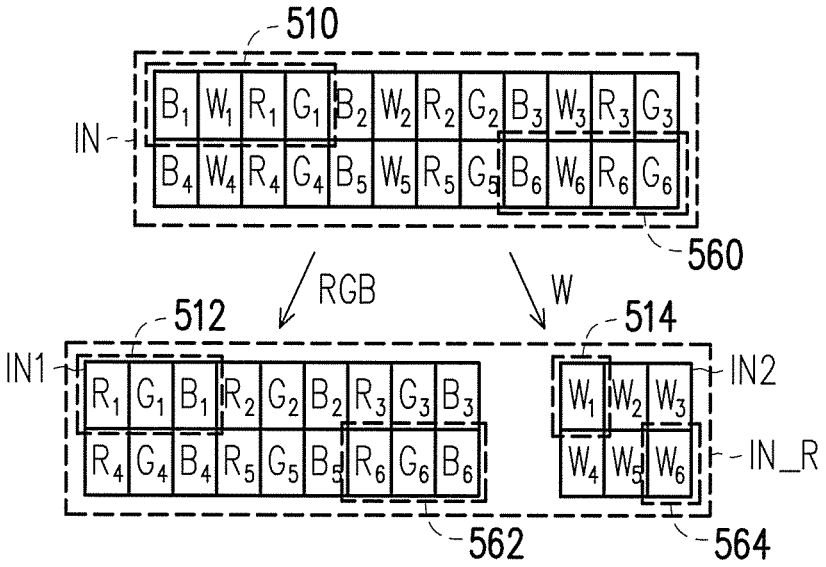
Figure 5B:
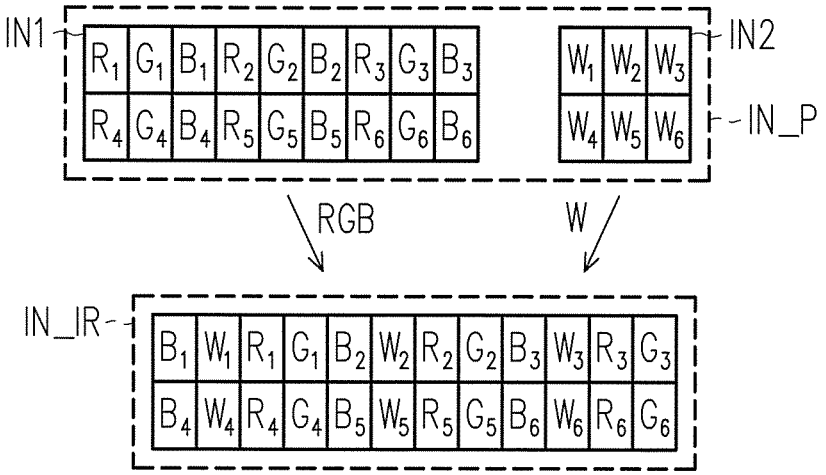

FIG. 5A illustrates a schematic diagram of sub-pixel arrangements of the frame data IN and the frame data IN_R according to another embodiment of the invention. FIG. 5B illustrates a schematic diagram of sub-pixel arrangements of the frame data IN_P and the frame data IN_IR according to another embodiment of the invention. Referring to FIG. 3A to FIG. 3B and FIG. 5A to FIG. 5B, the sub-pixel arrangements of the present embodiment are similar to the sub-pixel arrangements depicted in FIG. 3A and FIG. 3B, and the main difference therebetween, for example, lies in that relative positions of the sub-pixels after reorder are different from relative positions of the sub-pixels before reorder.

To be specific, in FIG. 5A, taking the pixels 510 and 560 for example, relative positions of the sub-pixels $R_1$, $G_1$ and $B_1$ after reorder are different from relative positions of the sub-pixels $B_1$, $R_1$ and $G_1$ before reorder, and relative positions of the sub-pixels $R_6$, $G_6$ and $B_6$ after reorder are different from relative positions of the sub-pixels $B_6$, $R_6$ and $G_6$ before reorder. The sub-pixel arrangements of other pixels located in the first row and the second row of the frame data IN and the frame data IN1 may be deduced by analogy, and it is not further described herein.

Figure 6A:
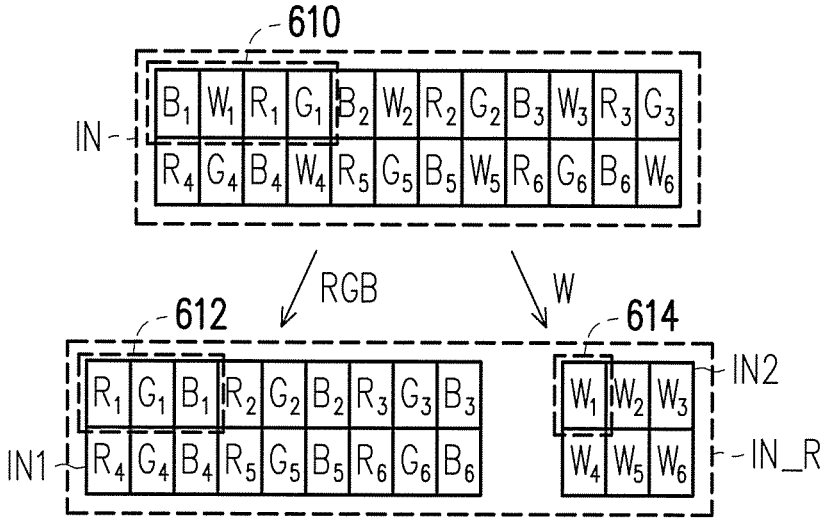
Figure 6B:
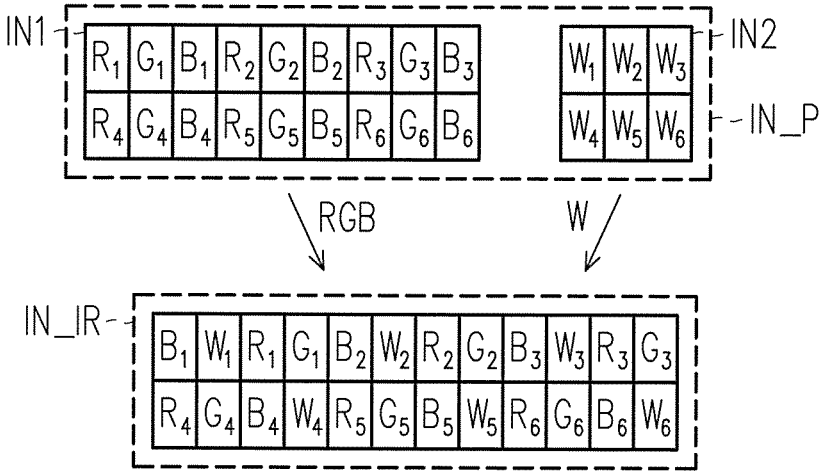

FIG. 6A illustrates a schematic diagram of sub-pixel arrangements of the frame data IN and the frame data IN_R according to another embodiment of the invention. FIG. 6B illustrates a schematic diagram of sub-pixel arrangements of the frame data IN_P and the frame data IN_IR according to another embodiment of the invention. Referring to FIG. 3A to FIG. 3B and FIG. 6A to FIG. 6B, the sub-pixel arrangements of the present embodiment are similar to the sub-pixel arrangements depicted in FIG. 3A and FIG. 3B, and the main difference therebetween, for example, lies in that relative positions of the sub-pixels after reorder are different from relative positions of the sub-pixels before reorder.

To be specific, in FIG. 6A, taking the pixel 610 for example, relative positions of the sub-pixels $R_1$, $G_1$ and $B_1$ after reorder are different from relative positions of the sub-pixels $B_1$, $R_1$ and $G_1$ before reorder. The sub-pixel arrangements of other pixels located in the first row of the frame data IN and the frame data IN1 may be deduced by analogy, and it is not further described herein.

In the exemplary embodiments depicted in FIG. 3A to FIG. 6B, relative positions of the sub-pixels $W_1$ to $W_6$ after reorder are the same as relative positions of the sub-pixels $W_1$ to $W_6$ before reorder, but the invention is not limited thereto. In an embodiment, the relative positions of the sub-pixels $W_1$ to $W_6$ after reorder may be different from the relative positions of the sub-pixels $W_1$ to $W_6$ before reorder. In addition, the sub-pixel arrangements depicted in FIG. 3A to FIG. 6B are exemplarily disclosed for description, and the invention is not intended to limit the sub-pixel arrangements of the frame data.

Figure 7:
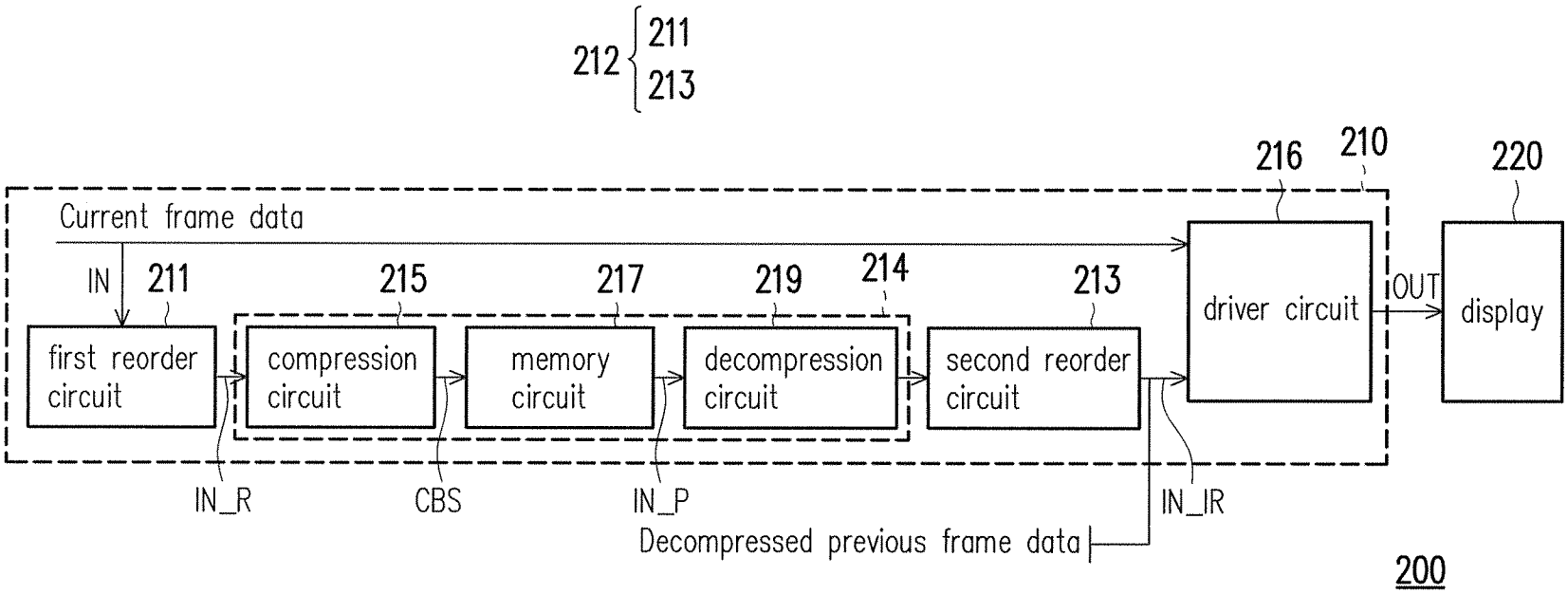
FIG. 7 illustrates a schematic diagram of a display driving system according to another embodiment of the invention.

FIG. 7 illustrates a schematic diagram of a display driving system according to another embodiment of the invention. Referring to FIG. 7, the image processing operation is applied to the frame data to compress and/or decompress the frame data in the present embodiment. The driver circuit 216 outputs the driving signal OUT to drives the display 220 according to the previous frame data and the current frame data, where pixels of the previous frame data have been reordered. In the present embodiment, the driver circuit 216 may include an LCD overdrive circuit. The previous frame data and the current frame data are used to obtain an appropriate overdrive value according to a lookup table (LUT), for example.

In the present embodiment, the pixel reorder circuit 212 is configured to reorder the pixels of the frame data IN, and output the frame data IN_IR to the driver circuit 216, where the image processing operation has been applied to the frame data IN_IR. The pixel reorder circuit 212 includes a first reorder circuit 211 and a second reorder circuit 213. After sub-pixel rendering, the frame data IN may have different arrangements among sub-pixels, such as the sub-pixel arrangements depicted in FIG. 3A, FIG. 4A, FIG. 5A and FIG. 6A. The first reorder circuit 211 receives the frame data IN, and reorders the pixels of the frame data IN to generate the frame data IN_R. Before compression, the frame data IN is separated into the frame data IN1 and IN2 by the first reorder circuit 211 as illustrated in FIG. 3A, FIG. 4A, FIG. 5A or FIG. 6A. After decompression, the second reorder circuit 213 receives the decompressed frame data IN_P, and reorders the pixels of the frame data IN to generate the frame data IN_IR as illustrated in FIG. 3B, FIG. 4 B, FIG. 5 B or FIG. 6 B. The frame data IN1 and IN2 are combined into the frame data IN_IR in a manner of inverse pixel reorder, such that the frame data IN_IR has the same sub-pixel arrangement as that of the frame data IN.

In the present embodiment, the image processing circuit 214 is configured to perform the image processing operation on the frame data IN_R, and generate the frame data IN_P, where the frame data IN_P is the frame data IN_R that the image processing operation has been applied. The image processing circuit 214 includes a compression circuit 215, a memory circuit 217 and a decompression circuit 219.

The compression circuit 215 is coupled to the first reorder circuit 211. The compression circuit 215 compresses the frame data IN_R that the pixels have been reordered, so as to generate the compressed frame data IN_P, and outputs a compressed bit stream CBS to the memory circuit 217, where the compressed bit stream CBS includes the compressed frame data IN_P. The memory circuit 217 is coupled to the compression circuit 215, and stores the compressed frame data IN_P. In the present embodiment, the memory circuit 217 may include a frame buffer. Frame buffer compression can reduce memory size and traffic for storing the previous frame data. The decompression circuit 219 is coupled to the memory circuit 217. The decompression circuit 219 decompresses the compressed frame data IN_P from the memory circuit 217, and transmits the decompressed frame data IN_P to the second reorder circuit 213.

In the present embodiment, when the image processing circuit 214 performs the image processing operation, e.g. compression and/or decompression, on the frame data IN_R that the pixels have been reordered, the image processing circuit 214 processes the frame data IN_R that the pixels have been reordered by using the compression circuit 215, and inversely processes the processed frame data IN_P by using the decompression circuit 219.

In the present embodiment, the first reorder circuit 211 and the second reorder circuit 213 are arranged for pixel reorder and inverse pixel reorder to improve compression quality. In an embodiment, the frame data IN1 and IN2 may be processed by different compression channels to achieve better compression quality or higher compression efficiency.

In the present embodiment, the first reorder circuit 211, the second reorder circuit 213, the compression circuit 215, the memory circuit 217 and the decompression circuit 219 may be implemented by using any adaptive circuit in the related art, which are not particularly limited by the invention. Enough teaching, suggestion, and implementation illustration for aforesaid circuits and embodiments thereof may be obtained with reference to common knowledge in the related art, which is not repeated hereinafter.

Figure 8:
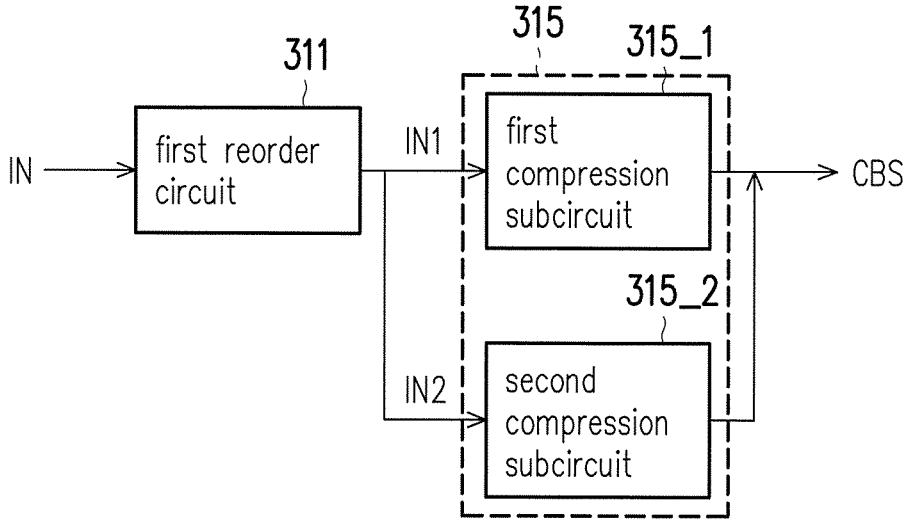
FIG. 8 illustrates a schematic diagram of a compression circuit according to an embodiment of the invention.
Figure 9:
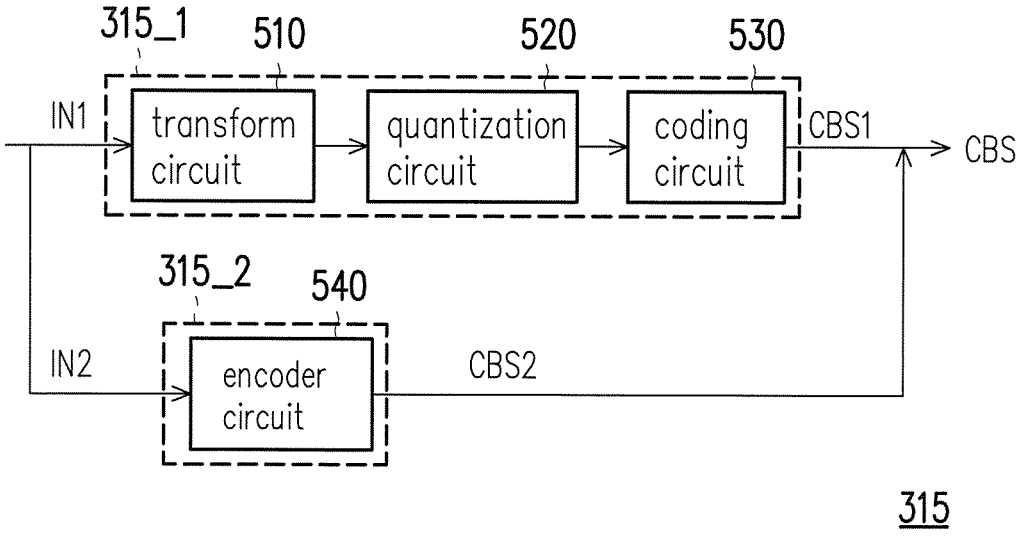
FIG. 9 illustrates a schematic diagram of compression subcircuits depicted in FIG. 8.

FIG. 8 illustrates a schematic diagram of a compression circuit according to an embodiment of the invention. FIG. 9 illustrates a schematic diagram of compression subcircuits depicted in FIG. 8. Referring to FIG. 8 and FIG. 9, the compression circuit 315 of the present embodiment includes two data processing channels. In the present embodiment, the first reorder circuit 311 separates the frame data IN into the frame data IN1 and IN2. The two data processing channels respectively process the frame data IN1 of the first sub-pixel set and the frame data IN2 of the second sub-pixel set. For example, a first compression subcircuit 315_1 may locate in one of the two data processing channels, and processes the frame data IN1 including red sub-pixels, green sub-pixels, and blue sub-pixels. A second compression subcircuit 315_2 locates in the other one of the two data processing channels, and processes the frame data IN2 including white sub-pixels, yellow sub-pixels, green sub-pixels, or cyan sub-pixels.

In the present embodiment, the compression circuit 315 may separately compress the frame data IN1 and the frame data IN2 according to the same compression rate. In an embodiment, the compression circuit may separately compress the frame data IN1 and the frame data IN2 according to different compression rates.

In the present embodiment, the first compression subcircuit 315_1 includes a transform circuit 510, a quantization circuit 520, and a coding circuit 530. The transform circuit 510 performs discrete cosine transform (DCT) or other similar transforms on the frame data IN1. The quantization circuit 520 performs quantization or other similar operations on the frame data IN1 to reduce information thereof. The coding circuit 530 performs variable-length coding (VLC) or other similar operations on the frame data IN1 to generate a compressed bit stream CBS1. In the present embodiment, the second compression subcircuit 315_2 includes an encoder circuit 540 performs block truncation coding (BTC) or other similar operations on the frame data IN2 to generate a compressed bit stream CBS2. The compressed bit stream CBS1 and the compressed bit stream CBS2 are combined together as the output compressed bit stream CBS.

In the present embodiment, the transform circuit 510, the quantization circuit 520, the coding circuit 530, and the encoder circuit 540 may be implemented by using any adaptive circuit in the related art, which are not particularly limited by the invention. Enough teaching, suggestion, and implementation illustration for aforesaid circuits and embodiments thereof may be obtained with reference to common knowledge in the related art, which is not repeated hereinafter.

Figure 10:
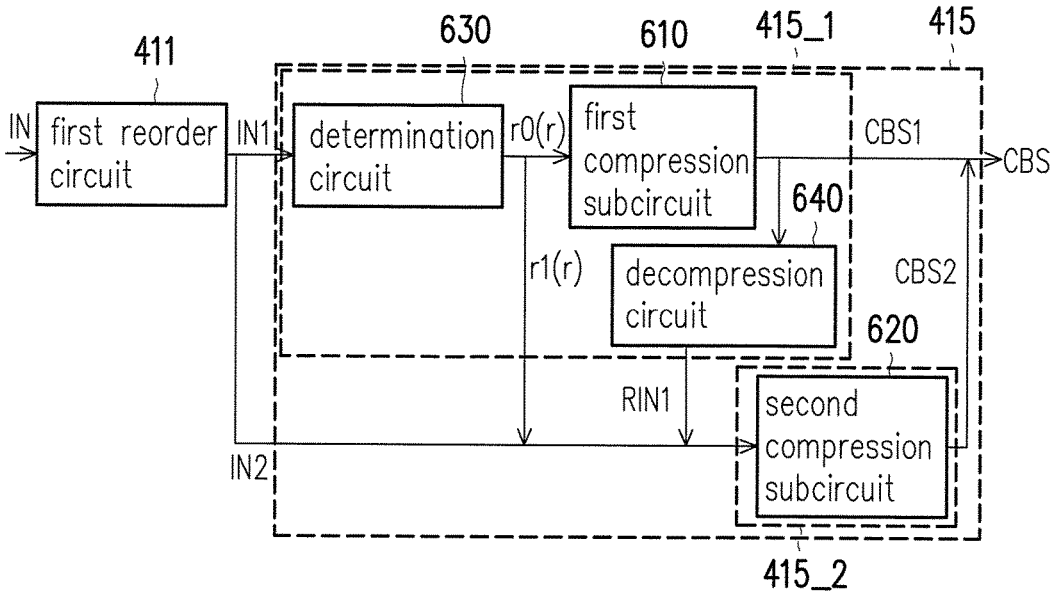
FIG. 10 illustrates a schematic diagram of a compression circuit according to another embodiment of the invention.
Figure 11:
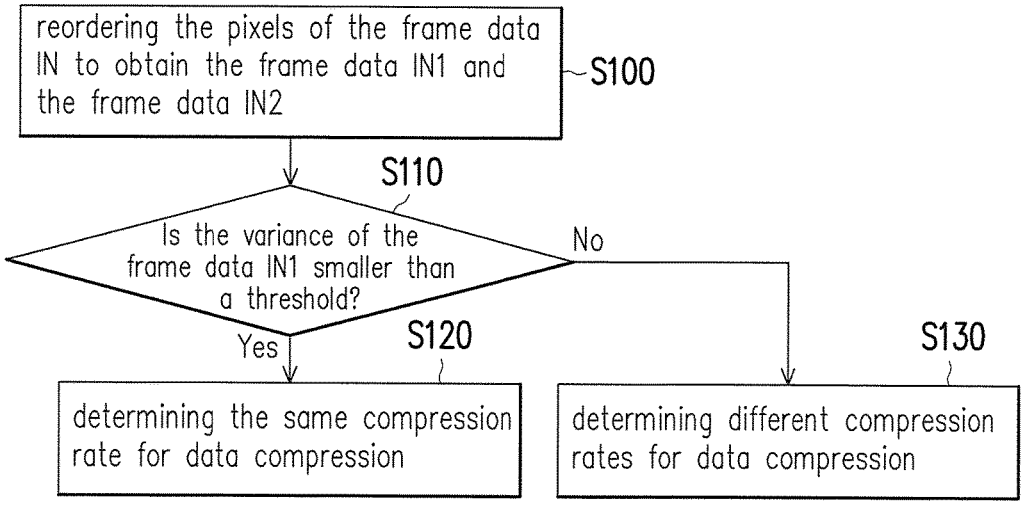
FIG. 11 is a flowchart illustrating steps in a method for pixel analysis and compression rate determination according to an embodiment of the invention.

FIG. 10 illustrates a schematic diagram of a compression circuit according to another embodiment of the invention. FIG. 11 is a flowchart illustrating steps in a method for pixel analysis and compression rate determination according to an embodiment of the invention. Referring to FIG. 10 to FIG. 11, the method for pixel analysis and compression rate determination is at least adapted to the compression circuit 415 depicted in FIG. 10, but the invention is not limited thereto.

In the present embodiment, the image processing circuit, e.g. the compression circuit 415, performs the image processing operation on one of the first sub-pixel set and the second sub-pixel set according to the other of the first sub-pixel set and the second sub-pixel set. For example, the compression circuit 415 compresses the second sub-pixel sets $W_1$ to $W_6$ of the frame data IN2 according to the first sub-pixel sets $R_1$ to $R_6$, $G_1$ to $G_6$ and $B_1$ to $B_6$ of the frame data IN1. In addition, the compression circuit 415 separately compresses the frame data IN1 and the frame data IN2 according to different compression rates, e.g. r0 and r1, or according to the same compression rate, e.g. r, in the present embodiment.

In the present embodiment, the compression circuit 415 comprises two data processing channels 415_1 and 415_2. The two data processing channels 415_1 and 415_2 are configured to respectively process the frame data IN1 of the first sub-pixel sets $R_1$ to $R_6$, $G_1$ to $G_6$ and $B_1$ to $B_6$ and the frame data IN2 of the second sub-pixel sets $W_1$ to $W_6$. The data processing channel 415_1 includes a determination circuit 630, a first compression subcircuit 610, and a decompression circuit 640. The data processing channel 415_2 includes a second compression subcircuit 620.

Description regarding how the compression circuit 415 analyses pixels and determines compression rates is provided as follows. In step S100, the first reorder circuit 411 receives the frame data IN, and reorders the pixels of the frame data IN, so as to separate the frame data IN into the frame data IN1 including the first sub-pixel sets $R_1$ to $R_6$, $G_1$ to $G_6$ and $B_1$ to $B_6$ and the frame data IN2 including the second sub-pixel sets $W_1$ to $W_6$. The first reorder circuit 411 transmits the frame data IN1 to the determination circuit 630 for pixel analysis, and transmits the frame data IN2 to the second compression subcircuit 620 for data compression.

In step S110, the determination circuit 630 analyses a variance of the first sub-pixel sets $R_1$ to $R_6$, $G_1$ to $G_6$ and $B_1$ to $B_6$ of the frame data IN1 to determine whether the variance is smaller than a threshold. In the present embodiment, the variance of the frame data may refer to a variance of image content. If the variance is smaller than the threshold, the determination circuit 630 determines the same compression rate r for data compression in step S120. The first compression subcircuit 610 and the second compression subcircuit 620 separately compress the frame data N1 and the frame data IN2 according to according to the same compression rate r. If the variance is not smaller than the threshold, the determination circuit 630 determines different compression rates r0 and r1 for data compression in step S130. The first compression subcircuit 610 compresses the frame data IN1 according to according to the compression rate r0. The second compression subcircuit 620 compresses the frame data IN2 according to the compression rate r1. In the present embodiment, the compression rate r0 may higher than the compression rate r1.

In the present embodiment, after the compression rate is determined, the frame data IN1 is first compressed and then reconstructed. The reconstructed frame data IN1 is used by the second compression subcircuit 620. To be specific, the first compression subcircuit 610 compresses the frame data IN1 to generate a compressed bit stream CBS1. The compressed bit stream CBS1 is transmitted to the decompression circuit 640 for reconstruction. The decompression circuit 640 decompresses the compressed bit stream CBS1 to generate a reconstructed frame data RIN1. The second compression subcircuit 620 receives the reconstructed frame data RIN1, and compresses the frame data IN2 according to the reconstructed frame data RIN1 and the compression rate r1. The second compression subcircuit 620 compresses the frame data IN2 to generate a compressed bit stream CBS2. The compressed bit stream CBS1 and the compressed bit stream CBS2 are combined together as the output compressed bit stream CBS.

Therefore, in the present embodiment, the compression circuit 415 compresses the second sub-pixel sets $W_1$ to $W_6$ of the frame data IN2 according to the first sub-pixel sets $R_1$ to $R_6$, $G_1$ to $G_6$ and $B_1$ to $B_6$ of the frame data IN1, but the invention is not limited thereto. In an embodiment, the compression circuit 415 may compress the first sub-pixel sets $R_1$ to $R_6$, $G_1$ to $G_6$ and $B_1$ to $B_6$ of the frame data IN1 according to the second sub-pixel sets $W_1$ to $W_6$ of the frame data IN2.

In the present embodiment, the first reorder circuit 411, the determination circuit 630, the first compression subcircuit 610, and the decompression circuit 640 may be implemented by using any adaptive circuit in the related art, which are not particularly limited by the invention. Enough teaching, suggestion, and implementation illustration for aforesaid circuits and embodiments thereof may be obtained with reference to common knowledge in the related art, which is not repeated hereinafter.

Figure 12:
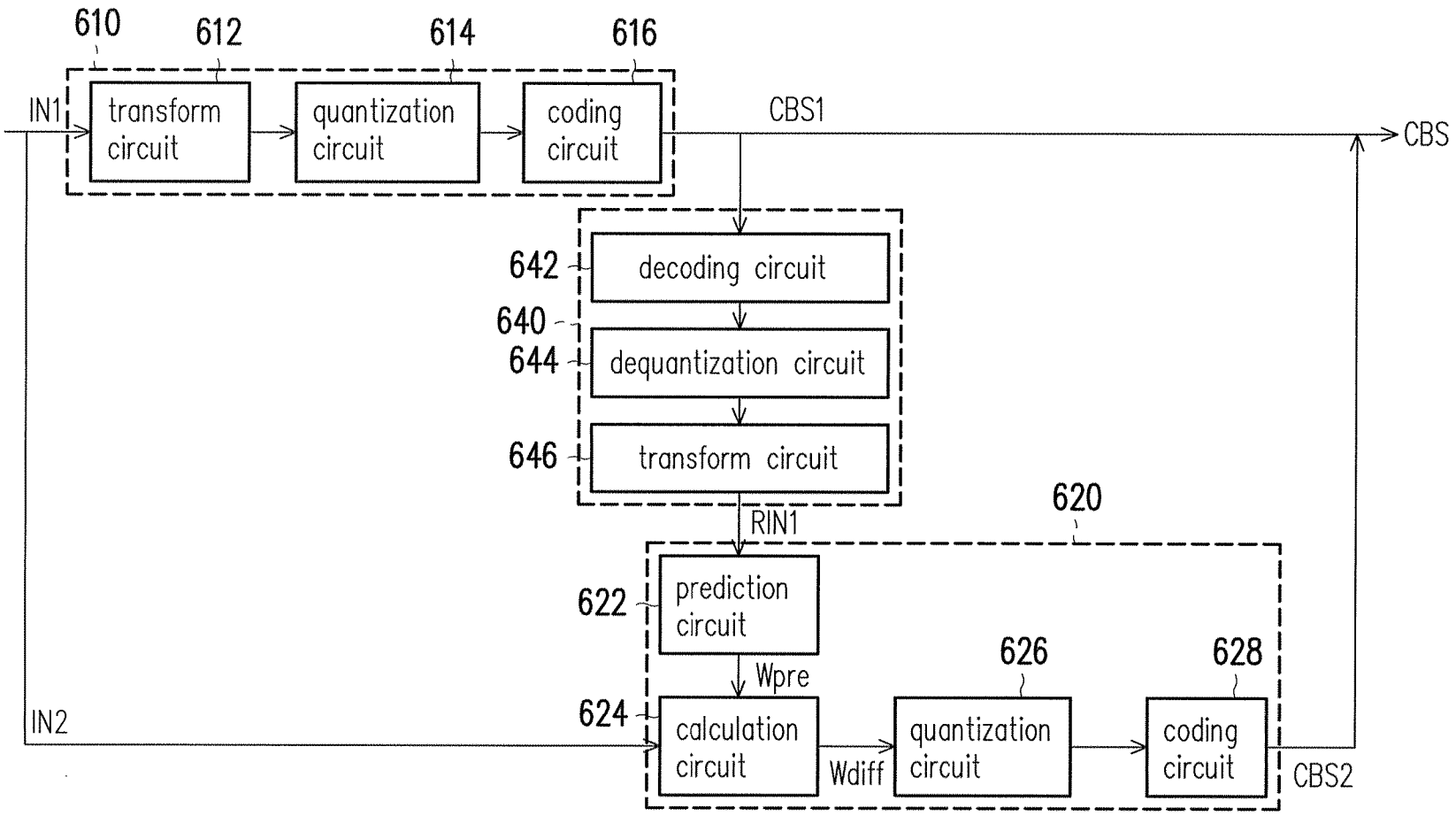
FIG. 12 illustrates a schematic diagram of compression subcircuits and a decompression circuit depicted in FIG. 10.

FIG. 12 illustrates a schematic diagram of compression subcircuits and a decompression circuit depicted in FIG. 10. Referring to FIG. 10 and FIG. 12, the first compression subcircuit 610 of the present embodiment is similar to the first compression subcircuit 315_1 depicted in FIG. 9. The operation of the first compression subcircuit 610 described in the present embodiment is sufficiently taught, suggested, and embodied in the embodiment illustrated in FIG. 9, and therefore no further description is provided herein. The compressed bit stream CBS1 is generated and outputted to the decompression circuit 640 by the first compression subcircuit 610.

In the present embodiment, the decompression circuit 640 includes a decoding circuit 642, a dequantization circuit 644, and a transform circuit 646. The coding circuit 642 performs a VLC decoding or other similar operations on the compressed bit stream CBS1, and outputs a decoded compressed bit stream CBS1 to the dequantization circuit 644. The dequantization circuit 644 performs dequantization or other similar operations on the decoded compressed bit stream CBS1 to reconstruct information thereof. The transform circuit 646 performs inverse discrete cosine transform (IDCT) or other similar transforms on the decoded compressed bit stream CBS1 that the dequantization has been performed, and generates the reconstructed frame data RIN1. The first sub-pixel sets $R_1$ to $R_6$, $G_1$ to $G_6$ and $B_1$ to $B_6$ of the frame data IN1 is reconstructed and outputted to the second compression subcircuit 620.

In the present embodiment, the second compression subcircuit 620 includes a prediction circuit 622, a calculation circuit 624, a quantization circuit 626, and a coding circuit 628. The prediction circuit 622 receives the reconstructed frame data RIN1, and generates a prediction value Wpre according to the reconstructed frame data RIN1. The prediction value Wpre may be selected from a minimum value of a red pixel, a green pixel, and a blue pixel of the reconstructed frame data RIN1. For example, for the second sub-pixel set $W_1$, the prediction value Wpre may be selected from a minimum pixel value of a red pixel $R_1'$, a green pixel $G_1'$, and a blue pixel $B_1'$ of the reconstructed frame data RIN1, i.e. Wpre=min (R', G', B'). The prediction values Wpre for other second sub-pixel sets $W_2$ to $W_6$ can be deduced by analogy, and it is not further described herein.

In the present embodiment, the calculation circuit 624 calculates a difference value Wdiff for each of the second sub-pixel sets $W_1$ to $W_6$. The difference value Wdiff is residual between a value of the second sub-pixel set and the prediction value Wpre thereof. For example, for the second sub-pixel set $W_1$, the difference value Wdiff is residual between a value of the second sub-pixel set $W_1$ and the prediction value Wpre thereof. The difference value Wdiff for other second sub-pixel sets $W_2$ to $W_6$ can be deduced by analogy, and it is not further described herein.

In the present embodiment, the quantization circuit 626 performs quantization or other similar operations on the frame data IN2 to reduce information thereof according to the difference value Wdiff. The coding circuit 628 performs variable-length coding (VLC) or other similar operations on the frame data IN2 to generate the compressed bit stream CBS2. The compressed bit stream CBS1 and the compressed bit stream CBS2 are combined together as the output compressed bit stream CBS.

In the present embodiment, the circuit blocks exemplarily disclosed in FIG. 12 may be implemented by using any adaptive circuit in the related art, which are not particularly limited by the invention. Enough teaching, suggestion, and implementation illustration for aforesaid circuits and embodiments thereof may be obtained with reference to common knowledge in the related art, which is not repeated hereinafter.

Figure 13:
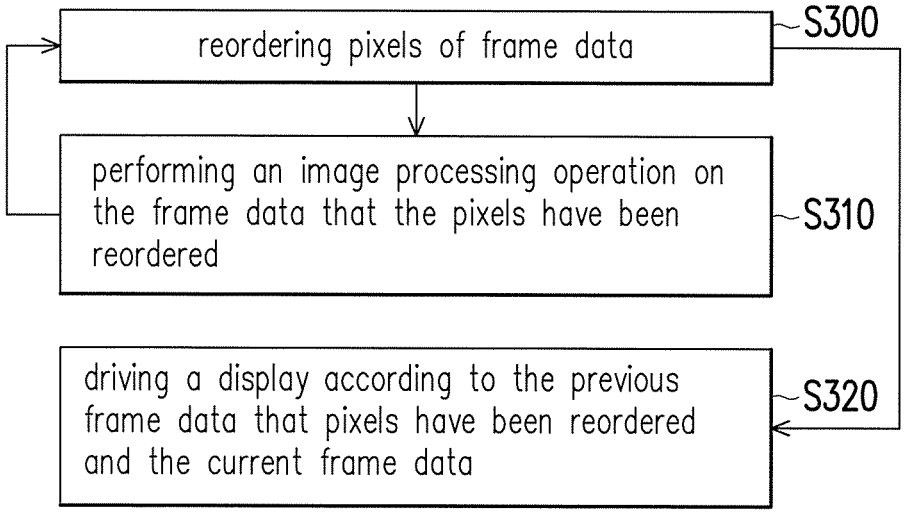
FIG. 13 is a flowchart illustrating steps in a display driving method according to an embodiment of the invention.

FIG. 13 is a flowchart illustrating steps in a display driving method according to an embodiment of the invention. Referring to FIG. 1, FIG. 2 and FIG. 13, the display driving method of the present embodiment is at least adapted to the display apparatus 100 depicted in FIG. 1, but the invention is not limited thereto. Taking the display apparatus 100 of FIG. 1 for example, in step S300, the pixel reorder circuit 112 reorders the pixels of the frame data IN. In step S310, the image processing circuit 114 performs an image processing operation on the frame data IN_R that the pixels have been reordered. The method returns to step S300, and the pixel reorder circuit 112 further reorders the pixels of the frame data IN_P that the image processing operation has been applied. After the pixels of the frame data IN_P is reordered, the method goes to step S320. In step S320, the driver circuit 116 drives the display 120 according to the previous frame data that pixels have been reordered and the current frame data.

The display driving method described in the present embodiment of the invention is sufficiently taught, suggested, and embodied in the embodiments illustrated in FIG. 1 to FIG. 12, and therefore no further description is provided herein.

Figure 14:
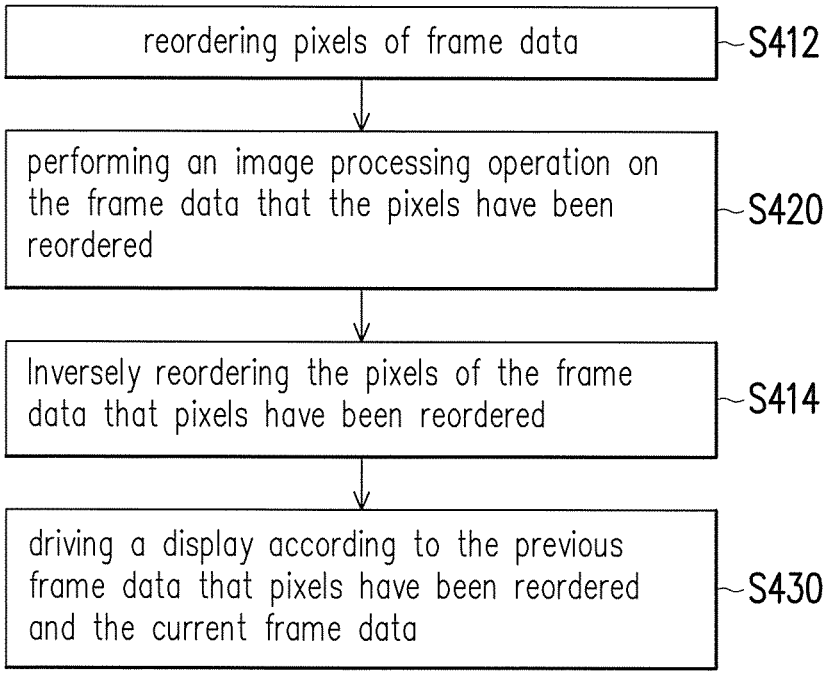
FIG. 14 is a flowchart illustrating steps in a display driving method according to another embodiment of the invention.

FIG. 14 is a flowchart illustrating steps in a display driving method according to another embodiment of the invention. Referring to FIG. 7 and FIG. 14, the display driving method of the present embodiment is at least adapted to the display apparatus 200 depicted in FIG. 7, but the invention is not limited thereto. Taking the display apparatus 200 of FIG. 7 for example, in step S412, the first reorder circuit 211 reorders the pixels of the frame data IN. In step S420, the image processing circuit 214 performs an image processing operation on the frame data IN_R that the pixels have been reordered. In step S414, the second reorder circuit 213 inversely reorders the pixels of the frame data IN_P that the image processing operation has been applied. In step S430, the driver circuit 216 drives the display 220 according to the previous frame data that pixels have been reordered and the current frame data.

The display driving method described in the present embodiment of the invention is sufficiently taught, suggested, and embodied in the embodiments illustrated in FIG. 1 to FIG. 13, and therefore no further description is provided herein.

In summary, in the exemplary embodiments of the invention, the pixels are reordered before the image process operation, and the pixels are further reordered after the image process operation. The image processing operation is separately or jointly performed on the first sub-pixel set and the second sub-pixel set according to the same parameter or different parameters. Accordingly, the display driving apparatus can improve image process quality and enhance image process efficiency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display driving apparatus comprising:

a pixel reorder circuit configured to reorder pixels of frame data, wherein the frame data comprises previous frame data;

an image processing circuit coupled to the pixel reorder circuit and configured to perform an image processing operation on the frame data that the pixels have been reordered; and a driver circuit coupled to the pixel reorder circuit and configured to drive a display according to the previous frame data that pixels have been reordered and the current frame data, wherein each of the pixels of the frame data comprises a first sub-pixel set and a second sub-pixel set, and wherein the image processing circuit performs the image processing operation on one of the first sub-pixel set and the second sub-pixel set according to the other of the first sub-pixel set and the second sub-pixel set.

2. The display driving apparatus according to claim 1, wherein the image processing circuit separately performs the image processing operation on the first sub-pixel set and the second sub-pixel set according to the same parameter or different parameters.

3. The display driving apparatus according to claim 1, wherein the image processing circuit analyses a variance of the first sub-pixel set, and if the variance is smaller than the threshold, the image processing circuit performs the image processing operation on the first sub-pixel set and the second sub-pixel set according to the same parameter.

4. The display driving apparatus according to claim 3, wherein if the variance is not smaller than the threshold, the image processing circuit performs the image processing operation on the first sub-pixel set and the second sub-pixel set according to different parameters.

5. The display driving apparatus according to claim 1, wherein the pixels of the frame data comprise a plurality of sub-pixels, and relative positions of the sub-pixels after reorder are different from relative positions of the sub-pixels before reorder.

6. The display driving apparatus according to claim 1, wherein the pixels of the frame data comprise a plurality of sub-pixels, and relative positions of the sub-pixels after reorder are the same as relative positions of the sub-pixels before reorder.

7. The display driving apparatus according to claim 1, wherein the first sub-pixel set comprises a red sub-pixel, a first green sub-pixel, and a blue sub-pixel, and the second sub-pixel set comprises a sub-pixel selected from one of a white sub-pixel, a yellow sub-pixel, a second green sub-pixel, and a cyan sub-pixel.

8. The display driving apparatus according to claim 1, wherein when the image processing circuit performs the image processing operation on the frame data that the pixels have been reordered, the image processing circuit processes the frame data that the pixels have been reordered and inversely processes the processed frame data.

9. The display driving apparatus according to claim 1, wherein the image processing circuit comprises:

a compression circuit coupled to the pixel reorder circuit and configured to compress the frame data that the pixels have been reordered;

a memory circuit coupled to the compression circuit and configured to store the compressed frame data; and a decompression circuit coupled to the memory circuit and configured to decompress the compressed frame data from the memory circuit and transmit the decompressed frame data to the pixel reorder circuit.

10. The display driving apparatus according to claim 1, wherein the compression circuit comprises two data processing channels configured to respectively process the frame data of the first sub-pixel set and the second sub-pixel set.

11. A display driving method, adapted to a display driving apparatus, comprising:

reordering pixels of frame data, wherein the frame data comprises previous frame data;

performing an image processing operation on the frame data that the pixels have been reordered, wherein the image processing operation is performed on one of the first sub-pixel set and the second sub-pixel set according to the other of the first sub-pixel set and the second sub-pixel set; and driving a display according to the previous frame data that pixels have been reordered and the current frame data, wherein each of the pixels of the frame data comprises a first sub-pixel set and a second sub-pixel set.

12. The display driving method according to claim 11, wherein in the step of performing the image processing operation on the frame data that the pixels have been reordered, the image processing operation is separately performed on the first sub-pixel set and the second sub-pixel set according to the same parameter or different parameters.

13. The display driving method according to claim 11, further comprising:

analysing a variance of the first sub-pixel set, wherein if the variance is smaller than a threshold, in the step of performing the image processing operation on the frame data that the pixels have been reordered, the image processing operation is performed on the first sub-pixel set and the second sub-pixel set according to the same parameter.

14. The display driving method according to claim 13, wherein if the variance is not smaller than the threshold, in the step of performing the image processing operation on the frame data that the pixels have been reordered, the image processing operation is performed on the first sub-pixel set and the second sub-pixel set according to different parameters.

15. The display driving method according to claim 11, wherein the pixels of the frame data comprise a plurality of sub-pixels, and relative positions of the sub-pixels after reorder are different from relative positions of the sub-pixels before reorder.

16. The display driving method according to claim 11, wherein the pixels of the frame data comprise a plurality of sub-pixels, and relative positions of the sub-pixels after reorder are the same as relative positions of the sub-pixels before reorder.

17. The display driving method according to claim 11, wherein the first sub-pixel set comprises a red sub-pixel, a first green sub-pixel, and a blue sub-pixel, and the second sub-pixel set comprises a sub-pixel selected from one of a white sub-pixel, a yellow sub-pixel, a second green sub-pixel, and a cyan sub-pixel.

18. The display driving method according to claim 11, wherein in the step of performing the image processing operation on the frame data that the pixels have been reordered, the frame data that the pixels have been reordered is processed, and the processed frame data is inversely processed.

19. The display driving method according to claim 11, wherein the step of performing the image processing operation on the frame data that the pixels have been reordered comprises:

compressing the frame data that the pixels have been reordered;

storing the compressed frame data; and decompressing the compressed frame data from the memory circuit.

20. The display driving method according to claim 11, wherein in the step of reordering the pixels of the frame data, the reordered pixels of the frame data are further inversely reordered.

* * * * *